US009263027B2

(12) United States Patent
Hopkins et al.

(10) Patent No.: US 9,263,027 B2
(45) Date of Patent: Feb. 16, 2016

(54) BROADCAST SYSTEM USING TEXT TO SPEECH CONVERSION

(75) Inventors: Huw Hopkins, Basingstoke (GB); Timothy Edmunds, Basingstoke (GB)

(73) Assignee: SONY EUROPE LIMITED, Weybridge (GB)

( * ) Notice: Subject to any disclaimer, the term of this patent is extended or adjusted under 35 U.S.C. 154(b) by 1103 days.

(21) Appl. No.: 13/150,669

(22) Filed: Jun. 1, 2011

(65) Prior Publication Data

US 2012/0016675 A1 Jan. 19, 2012

(30) Foreign Application Priority Data

Jul. 13, 2010 (GB) ..... 1011751.3

(51) Int. Cl.
*G10L 13/00* (2006.01)
*G10L 13/08* (2013.01)
*G10L 13/047* (2013.01)

(52) U.S. Cl.
CPC ..... *G10L 13/08* (2013.01); *G10L 13/00* (2013.01); *G10L 13/047* (2013.01)

(58) Field of Classification Search
CPC ..... G10L 13/06; G10L 13/07; G10L 13/04; G10L 13/043; G10L 13/047; G10L 13/08
USPC ..... 704/258, 260
See application file for complete search history.

(56) References Cited

U.S. PATENT DOCUMENTS 5,787,231 A 7/1998 Johnson et al.
5,905,789 A * 5/1999 Will ..... 379/211.03
6,078,885 A 6/2000 Beutnagel
6,175,819 B1 * 1/2001 Van Alstine ..... 704/235
6,543,052 B1 * 4/2003 Ogasawara ..... 725/60
7,027,568 B1 4/2006 Simpson et al.
7,742,921 B1 6/2010 Davis et al.
7,945,445 B1 * 5/2011 Marschall et al. ..... 704/251
8,990,087 B1 * 3/2015 Lattyak et al. ..... 704/251

(Continued)

FOREIGN PATENT DOCUMENTS

EP 0 931 415 7/1999
EP 1 302 928 A1 4/2003

(Continued)

OTHER PUBLICATIONS

Extended Search Report issued Dec. 30, 2011 in Europe Application No. 11167756.3.

(Continued)

*Primary Examiner* — Eric Yen

(74) *Attorney, Agent, or Firm* — Oblon, McClelland, Maier & Neustadt, L.L.P.

(57) ABSTRACT

A broadcast signal receiver comprises a text data receiver for receiving broadcast text data for display to a user in relation to a user interface; a text-to-speech (TTS) converter for converting received text data into an audio speech signal, the TTS converter being operable to detect whether a word for conversion is included in a stored list of words for conversion and, if so, to convert that word according to a conversion defined by the stored list; and if not, to convert that word according to a set of predetermined conversion rules; a conversion memory storing the list of words for conversion by the TTS converter; and an update receiver for receiving additional words and associated conversions for storage in the conversion memory.

18 Claims, 6 Drawing Sheets

(56) References Cited

U.S. PATENT DOCUMENTS

| | | | | |
|---|---|---|---|---|
| 2002/0077822 | A1* | 6/2002 | Case | 704/260 |
| 2002/0087263 | A1* | 7/2002 | Wiener | 701/207 |
| 2002/0103648 | A1 | 8/2002 | Case et al. | |
| 2002/0123893 | A1* | 9/2002 | Woodward | 704/250 |
| 2003/0046077 | A1 | 3/2003 | Bakis et al. | |
| 2003/0055654 | A1* | 3/2003 | Oudeyer | 704/275 |
| 2003/0061048 | A1* | 3/2003 | Wu et al. | 704/260 |
| 2003/0105639 | A1* | 6/2003 | Naimpally et al. | 704/276 |
| 2003/0130847 | A1* | 7/2003 | Case | 704/260 |
| 2004/0049389 | A1* | 3/2004 | Marko et al. | 704/260 |
| 2004/0054534 | A1* | 3/2004 | Junqua | 704/258 |
| 2005/0060156 | A1 | 3/2005 | Corrigan et al. | |
| 2006/0015337 | A1* | 1/2006 | Kurzweil et al. | 704/235 |
| 2006/0217981 | A1* | 9/2006 | Mahmudovska et al. | 704/260 |
| 2006/0235691 | A1* | 10/2006 | Tomasic et al. | 704/257 |
| 2006/0287861 | A1* | 12/2006 | Fischer et al. | 704/260 |
| 2008/0134038 | A1* | 6/2008 | Oh et al. | 715/727 |
| 2008/0140406 | A1* | 6/2008 | Burazerovic et al. | 704/260 |
| 2009/0083035 | A1* | 3/2009 | Huang et al. | 704/260 |
| 2009/0281789 | A1* | 11/2009 | Waibel et al. | 704/3 |

FOREIGN PATENT DOCUMENTS

| | | | |
|---|---|---|---|
| EP | 2 053 595 | A1 | 4/2009 |
| GB | 2 393 369 | A | 3/2004 |
| GB | 2 395 388 | A | 5/2004 |
| GB | 2 405 018 | A | 2/2005 |
| WO | WO 2005/036786 | A1 | 4/2005 |
| WO | WO 2007/007256 | A1 | 1/2007 |

OTHER PUBLICATIONS

Partial Search Report issued Nov. 8, 2011 in Europe Application No. 11167756.3.

United Kingdom Search Report issued Oct. 7, 2010, in Great Britain 1011751.3, filed Jul. 13, 2010.

United Kingdom Search Report issued Feb. 7, 2011, in Great Britain 1011751.3, filed Jul. 13, 2010.

"Customizing Text to Speech Pronounciations", http://prsync.com/adobe/customizing-text-to-speech-pronounciations-2615/, Mar. 20, 2009, 1 page.

"Digital Video Broadcasting (DVB); Specification for System Software Update in DVB Systems", ETSI TS 102 006 V1.3.1, May 2004, 39 pages.

* cited by examiner

BROADCAST SYSTEM USING TEXT TO SPEECH CONVERSION

BACKGROUND OF THE INVENTION

1. Field of the Invention

This invention relates to broadcast systems using text-to-speech (TTS) conversion.

2. Description of the Prior Art

The invention is applicable to broadcast transmission and to various types of broadcast signal receiver, such as a television receiver or a mobile telephone handset. A problem will be described below in the context of television receivers merely in order to explain the technical background of the invention.

Television receivers have been proposed which make use of TTS conversion to assist blind or partially-sighted users. Two examples are disclosed in GB-A-2 405 018 and GB-A-2 395 388. In these examples, TTS techniques are used to reproduce data such as electronic programme guide (EPG) data and teletext data in an audible form.

EPG data in this context means programme listings provided in advance by the broadcaster, to allow a user to select a programme for viewing and/or recording, and data defining a current and a next programme being broadcast on a particular channel. Teletext data refers to textual data provided by the broadcaster as part of an information service. Examples of teletext data might include pages of news text, weather information, cinema listings and the like. All of these data have features in common: they are normally made available to the user by displaying the text on the television screen, and in practical terms they have an unlimited lexicon (vocabulary; set of available words). It is this feature of an unlimited lexicon can cause difficulties for a TTS system.

TTS techniques rely either on replaying pre-recorded voices relating to the words to be converted into speech by the TTS device, or by building full words from sub-elements of pronunciation known as phonemes. Phonemes are the basic units of speech sound, and basically represent the smallest phonetic units in a language that are capable of expressing a difference in meaning. TTS systems use sets of rules to generate successions of phonemes from the spellings of words to be converted into speech. In languages such as English, which contain many irregular pronunciations, these rules can be complex, especially when similar spellings have different pronunciations (for example: the set of characters "ough" in the English words "through", "though", "cough", "rough", "plough", "ought", "borough", "lough" etc, all of which have different pronunciations of those four characters). But despite these complications, TTS systems based on phonemes or on pre-recorded voices are generally arranged to cope with the complexities of words that are known in advance to the system designers.

However, it is practically impossible to predict in advance what words will appear in EPG data, teletext data and the like. For example, a broadcaster may introduce an abbreviation (for example "Spts" for a "sports" channel). In another example, a name of a programme presenter or a personality in the news may move into common use but might not normally have been included in the lexicon of a TTS system—for example "George Papandreou", "Lembit Opik", "Albus Dumbledore".

The Adobe® Captivate 4 TTS system provides the facility to customise TTS pronunciations, by the user rewriting a difficult-to-pronounce word in a more phonetic form which the TTS system can recognise and pronounce. But in the context of TTS conversion of EPG or teletext data, this arrangement would be of little use to a phoneme-based TTS system. Firstly, the EPG or teletext data is transient; the user might access it once only, and so the user would not choose to spend time designing and entering a replacement phonetic spelling to assist the TTS system. Secondly, the user might not even know how a particular word—for example an abbreviation such as "Spts"—should be pronounced. Thirdly, in a system aimed at the partially sighted or blind user, it would be an undue burden to expect the user to retype replacement phonetic spellings.

The arrangement of Adobe Captivate 4 is not relevant to a TTS system based on pre-recorded pronunciations.

SUMMARY OF THE INVENTION

This invention provides a broadcast signal receiver comprising a text data receiver for receiving broadcast text data for display to a user in relation to a user interface; a text-to-speech (TTS) converter for converting received text data into an audio speech signal, the TTS converter being operable to detect whether a word for conversion is included in a stored list of words for conversion and, if so, to convert that word according to a conversion defined by the stored list; and if not, to convert that word according to a set of predetermined conversion rules; a conversion memory storing the list of words for conversion by the TTS converter; and an update receiver for receiving additional words and associated conversions for storage in the conversion memory.

Various further respective aspects and features of the invention are defined in the appended claims.

The invention advantageously provides broadcast updates to the dictionary data used by TTS systems in, for example, television receivers.

BRIEF DESCRIPTION OF THE DRAWINGS

The above and other objects, features and advantages of the invention will be apparent from the following detailed description of illustrative embodiments which is to be read in connection with the accompanying drawings, in which.

DESCRIPTION OF THE PREFERRED EMBODIMENTS

Figure 1:
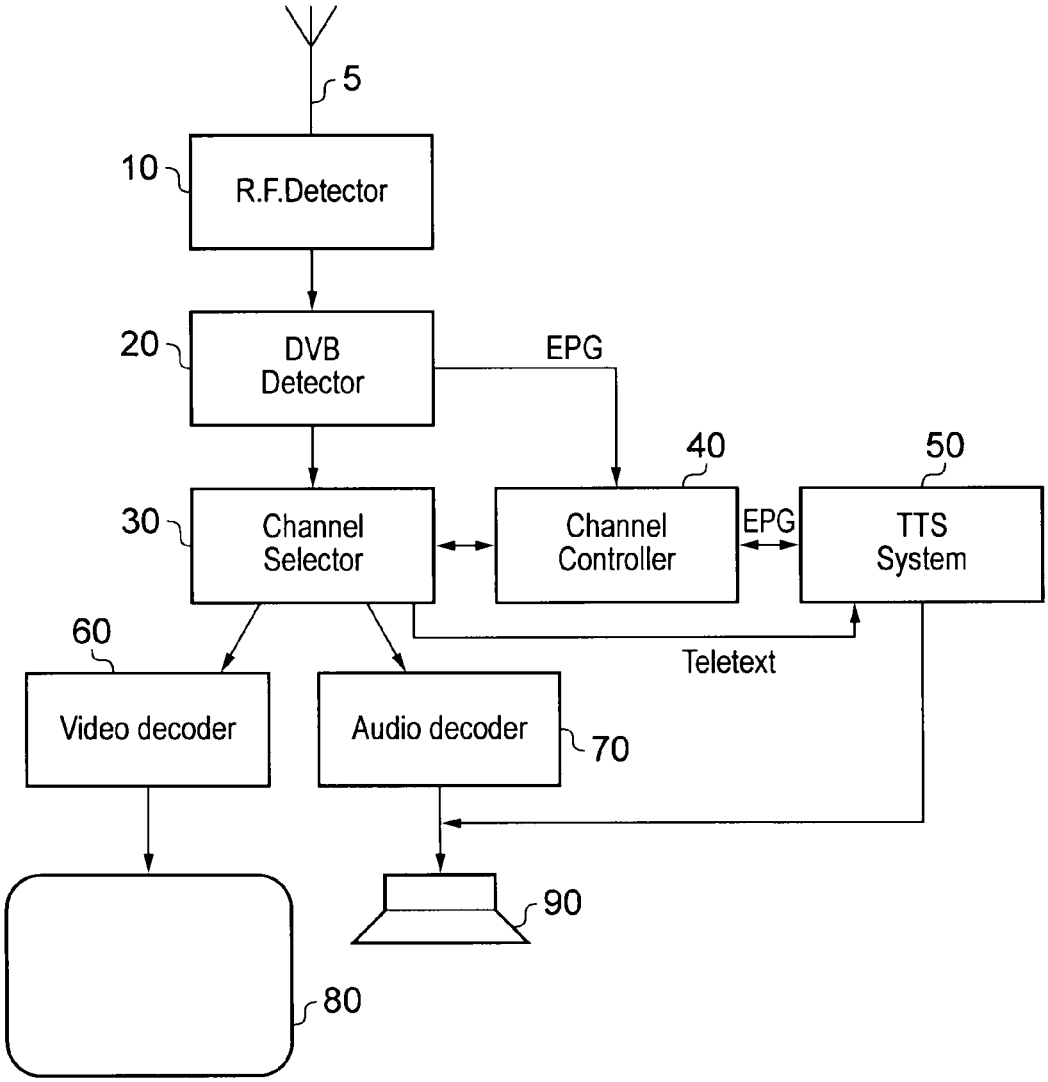
FIG. 1 schematically illustrates a television receiver.

FIG. 1 schematically illustrates a television receiver as an example of a broadcast signal receiver. Much of the operation of the television receiver is conventional, and so those aspects will be described only in summary form. The example shown in FIG. 1 is a receiver operating according to one or more of the Digital Video Broadcasting (DVB) standards such as the DVB-T standard.

An antenna 5, which may be a terrestrial or a satellite antenna, receives broadcast digital television signals. These are passed to a radio frequency (RF) detector 10 which demodulates the received RF signal down to baseband. Note that although the example uses antenna-based reception, the techniques described here are equally applicable to other broadcast delivery systems such as cable or IPTV (Internet protocol television) systems.

The baseband signal is then passed to a DVB detector 20. This is a schematic representation of those parts of a known DVB receiver which derive so-called digital video transport streams (TS) from the baseband broadcast signal and also those parts which act as a text data receiver to derive teletext data and service information (DVB-SI) such as electronic programme guide (EPG) data from the baseband broadcast signal. The transport streams are passed to a channel selector 30 which, under the control of a channel controller 40, allows the user to select a particular channel for viewing. Audio and video data streams corresponding to the selected channel are passed respectively to an audio decoder 70 (and from there to an amplifier and loudspeaker arrangement 90) and to a video decoder 60 (and from there to a display screen 80).

The display screen 80 and the amplifier and loudspeaker 90 can be provided as part of the receiver, as would be the situation with an integrated digital television receiver, or could be in a separate unit, as would be the case with a set top box (STB) containing the digital receiver coupled to a television set for display of the received signals.

The EPG data derived by the DVB detector 20 is buffered by the DVB detector and, when required, is passed to the channel controller 40. In response to an appropriate user command (for example using a remote commander, not shown in FIG. 1) the EPG data is displayed on the display screen 80, enabling the user to operate further controls to select one of the available channels for viewing.

A further type of EPG data is so-called "now and next" data, which provides a frequently updated indication of the name (and brief details) of the current programme which is viewable on a channel, and the name (and brief details) of the next programme on that channel.

An option which the user can select is the display of teletext information. Teletext is a low bit rate service (compared to the bit rate of a video service) which provides text and simple graphics for display. The term refers generally to broadcast textual services associated with broadcast audio and/or video systems, and includes teletext defined under analogue or digital broadcasting standards such as the DVB standard, text and interactive services defined by the Multimedia and Hypermedia information coding Expert Group (MHEG) or Multimedia Home Platform (MHP) systems including Java® applications and the like, and other such protocols for the delivery of textual and/or interactive services to broadcast receivers. Teletext services may be selectable as though they are individual channels in their own right, but another route into a teletext service provided by a broadcaster is to operate a particular user control while viewing a video channel provided by that broadcaster. When a teletext service is selected by the user, the channel selector routes the teletext data to the video decoder 60 to be rendered as a viewable page of information.

Accordingly, the text data receiver is arranged so as to receive broadcast text data for display to a user in relation to a user interface.

A text-to-speech (TTS) system 50 is also provided. This acts on certain categories of text displayed on the display screen 80 and converts the displayed (or the received) text data into an audio voice signal for output by the amplifier and loudspeaker 90. In the present example, the TTS system operates on EPG data (including now and next data) and teletext data. However, in other embodiments it would be possible for the TTS system to use known character recognition and to operate on any text displayed as part of the received video and/or data service.

In the examples discussed here, the TTS operation is applied to text being displayed on the display screen. However, the TTS operations could apply to other text such as non-displayed text.

In order to apply TTS techniques to the EPG and teletext data, the TTS system receives currently displayed EPG data, and the text of any selection (such as the text description of a particular programme at a particular time on a selected channel) made by the user, as text data from the channel controller 40. The TTS system receives any currently displayed teletext data, as text data, from the channel selector 30. The TTS system operates to convert these types of displayed text into a voice signal, starting (for example, at least in relation to English text) at the top left of the text as displayed, and progressing through the displayed text either in a normal reading order (in the case of teletext data) or in order of whichever portion of text the user is currently selecting (in the case of EPG data). In the latter case, it is common for a user to operate a movable cursor to navigate around EPG data, perhaps moving the cursor from the listing for one channel to the listing to another. The TTS operation can be set in a routine way according to the user interface in use on a particular television receiver. For example, if the user uses an "up/down" cursor control to move between channels and a "left/right" cursor control to change the time period for which information is displayed, the EPG listing, then after a predetermined pause (for example 0.8 seconds) in the cursor movement, the TTS system can start converting times and programme names for the currently selected channel and currently selected time period in the displayed EPG data.

Figure 3:
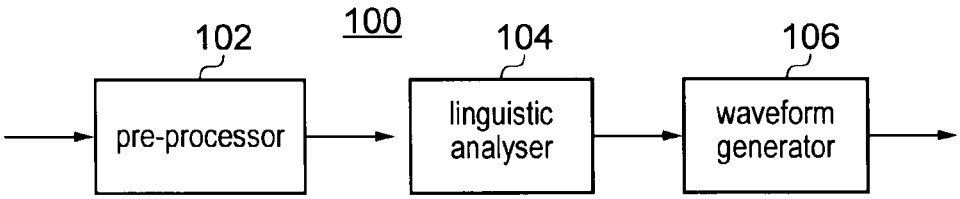
FIG. 3 schematically illustrates a TTS converter.
Figure 2:
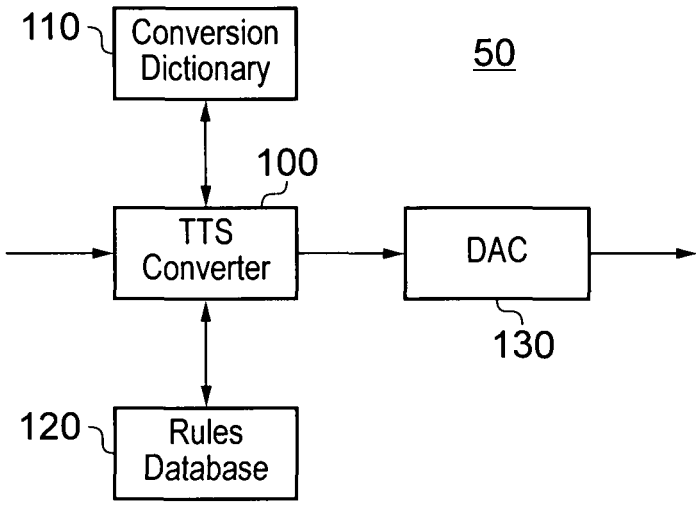
FIG. 2 schematically illustrates a TTS system.
Figure 4:
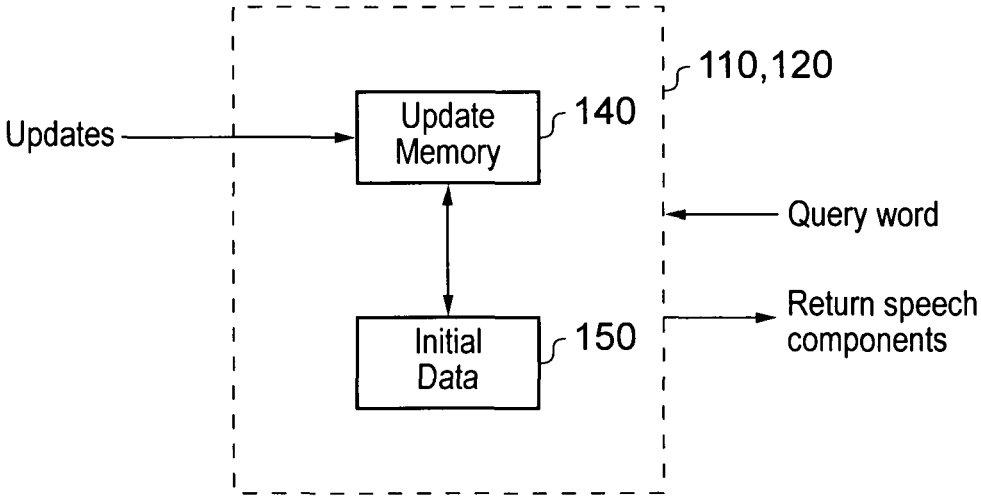
FIG. 4 schematically illustrates a conversion dictionary or a rules database.

The TTS system 50 will now be described. FIGS. 2 to 4 are schematic diagrams illustrating the operation of the TTS system 50. The TTS system 50 comprises a TTS converter 100, a conversion dictionary 110, a rules database 120 and a digital to audio converter (DAC) 130.

A TTS system converts normal language (rather than phonetic representations) into speech.

Speech can be synthesized in various ways. In a system with a limited lexicon or vocabulary (such as an automotive satellite navigation system), entire words or even phrases can be pre-recorded, which provides a high quality output for the limited set of words and phrases in use. In systems with a wider lexicon, the synthesized speech may be created by concatenating speech components such as phonemes. A further alternative is for the TTS system to model the operation of the human vocal tract and other voice characteristics. The example to be discussed with reference to FIGS. 2 to 4 is a phoneme-based TTS system.

The fundamental speech synthesis process as shown in FIGS. 2 to 3 operates in a generally conventional way and so will be described only in summary form here. As a first stage 102 (FIG. 3), the TTS system attempts to convert incoming text into words which can be correctly processed by later stages. This process is sometimes called text normalisation, pre-processing or tokenisation. For example, the number "5" appearing alone in a stream of incoming text would be converted to "five", whereas the group of adjacent symbols "523" might be converted to "five hundred and twenty three". The symbol "+" would be converted to the word "plus". All of these conversions are carried out on the basis of a look-up table which (for the purposes of FIG. 3) is considered part of the rules database 120. Text which cannot be parsed as a word might be converted into a set of initials: for example, "Spts" would be converted to the four successive initials "S P T S".

The output of the pre-processing stage 102 is passed to a linguistic analyser 104, which assigns phonetic transcriptions to each pre-processed word. As mentioned above, phonemes are individual speech components which are considered the smallest components capable of indicating differences in meaning. The linguistic analyser 104 selects a set or sequence of one or more phonemes or other speech components for each pre-processed word, with associated phasing, intonation and duration values.

Of course, for particularly commonly used words, or perhaps for words which have been sponsored by an advertiser, a digitised version of the whole word could be stored for selection by the linguistic analyser as a single component (rather than having to build the word from individual phonemes). An example here might be the name of a broadcaster or a channel, or the name of the television manufacturer.

The linguistic analyser assigns the phonemes using a combination of two general approaches. The first is a stored list- or dictionary-based approach, in which a large dictionary (implemented as the conversion dictionary 110, and in practice providing a stored list of words for conversion) contains, effectively, a look-up table mapping words to sets of phonemes. The linguistic analyser looks up each word in the dictionary and retrieves the correct set of phonemes. This approach is quick and accurate if a word is found in the dictionary; otherwise it fails. The other approach is a rules-based approach, in which a set of predetermined pronunciation rules (stored in the rules database 120) are applied to words to determine their pronunciations based on their spellings and to some extent their context, that is to say, the surrounding words. The rules-based approach can at least attempt to deal with any word, but as the system attempts to deal with more words, the rules themselves become more and more complicated. Therefore, many TTS systems (including that shown as the present embodiment) use a combination of these approaches. In simple terms this could mean that a dictionary based approach is used if a word is found in the stored list of words for conversion, in the conversion dictionary, and a rules-based approach is used otherwise, but that would not cope with heteronyms, which are spellings which are pronounced differently based on their context. Simple examples of English heteronyms include the words "close", "rebel", "moped" and "desert". Accordingly, in the present embodiment words of this nature are provided with rules-based assistance to select one of two or more dictionary-based pronunciations depending on the word's context, that is to say, the words surrounding that particular word. However, if the linguistic analyser does not find the word in the dictionary, it uses just the rules-based approach to make a best attempt at pronunciation.

The selected phonemes are then passed to a waveform generator 106 which concatenates or assembles the speech components or phonemes into an output digitized waveform relating to that word, according to the phasing, intonation and duration values set by the linguistic analyser 104. The phonemes are generally arranged so as to segue from one to the next, that is to say, to continue without a pause in the middle of an individual word. The waveform is converted to an analogue form for output by (for example) the amplifier and loudspeaker 90 by the DAC 130.

In summary terms, therefore, the TTS conversion system 50 makes use of information stored in the conversion dictionary 110 (acting as a conversion memory) and information stored in the rules database 120 during both of the pre-processing and the linguistic analysis stages.

FIG. 4 schematically illustrates the conversion dictionary 110 or the rules database 120, demonstrating features relevant to the update of the device's stored data. In schematic terms, the conversion dictionary and the rules database can be considered as having memory storage for initial data 150 and also an update memory 140 for receiving and storing updates to the initial data. The way in which updates are received will be described below. But in basic terms, when the conversion dictionary or the rules database receives a query (in the form of a word to be converted), the query is tested against the initial data first, and then against the data stored in the update memory. If any response is provided by the initial data, that response may be over-ridden by a response provided in respect of the update data.

Of course, the arrangement shown in FIGS. 2 and 4 is schematic. The conversion dictionary 110 and the rules database 120 need not be separate memories or separate data repositories, but could be embodied as a single data repository which returns rules and conversions relating to a queried word. Similarly, the initial data and the update data need not be stored separately; the update data could be incorporated into the initial data so as to form a combined data structure. Where the update data relates to a word which was not included in the initial data, the update data would simply be additional data. Where the update data relates to a word which was included in the initial data, the update data can be arranged to supplement or replace the corresponding initial data.

The update data can be received from a conversion repository as broadcast data or by a network (internet) connection. In either case, the issuing of the update data can be solely by the decision of the data provider (for example the broadcaster) or in response to an automated or manual request from the television receiver or its user. For example, the update can be handled as broadcast data using techniques defined by the DVB System Software Update standard ETSI TS 102 006 (see for example http://broadcasting.ru/pdf-standard-specifications/multiplexing/dvb-ssu/ts102006.v1.3.1.pdf)

The provision of update data via a network connection can in fact be indirect, for example by the broadcaster providing an internet link (e.g. a uniform resource identifier or URI) from which the update data is downloadable as a separate operation. Where for example the broadcast signal receiver has no network or internet browser capability or otherwise, the user could download the update data to a data carrier, such as a memory with a USB interface (not shown), using a personal computer (not shown) and plug the data carrier into a corresponding interface (not shown) of the broadcast signal receiver. This could be a USB interface or a serial port of the broadcast receiver.

Figure 5:
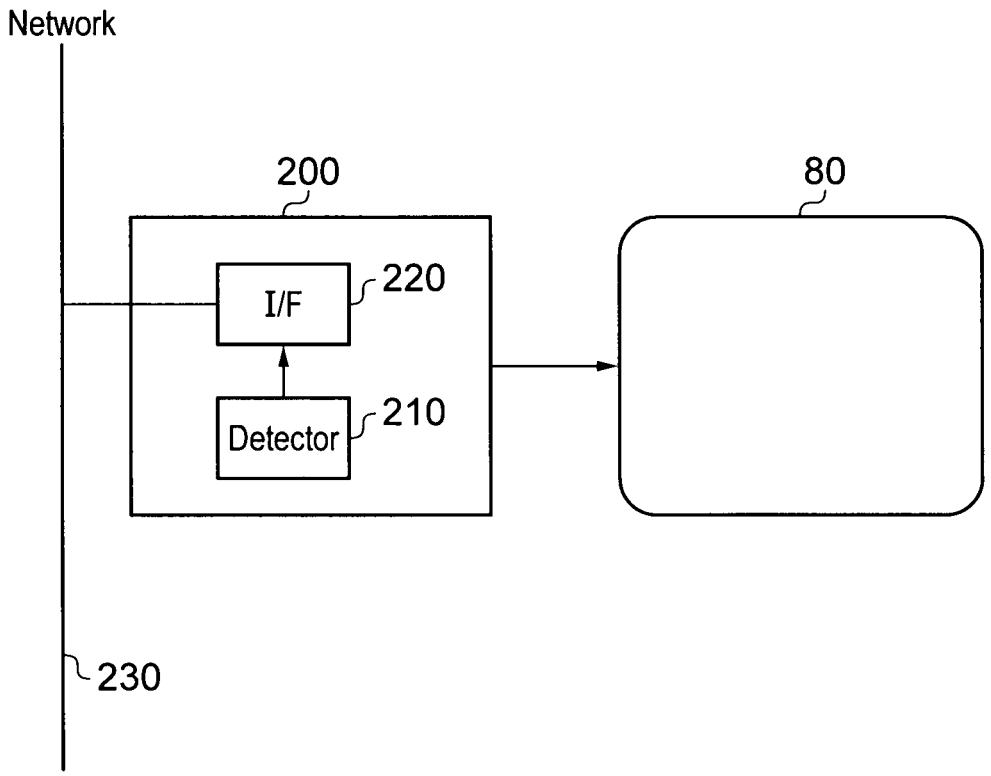
FIG. 5 schematically illustrates a receiver with a network connection.

FIG. 5 schematically illustrates a television receiver 200 similar to the receiver described in connection with FIG. 1. The receiver 200 is connected to the display screen 80. In addition to features already described, the television receiver 200 comprises a detector 210 and an interface 220 connected to a network connection 230 such as an internet connection.

The detector 210 interacts with the TTS system an in particular with the interaction between the TTS converter 100, the conversion dictionary 110 and the rules database 120. The detector 210 detects instances of a word for conversion not being included in the conversion dictionary, and either sends a message to the broadcaster, via the network connection 230, to request update data to be issued in respect of that word, or accesses a remote conversion repository (not shown) to search for conversion data relating to that word, which the detector can then download as update data. In this context, therefore, the detector acts as an update receiver.

The remote conversion repository could be, for example, a website operated by the broadcaster, by the television receiver manufacturer, or by a visual disability charity.

Figure 6:
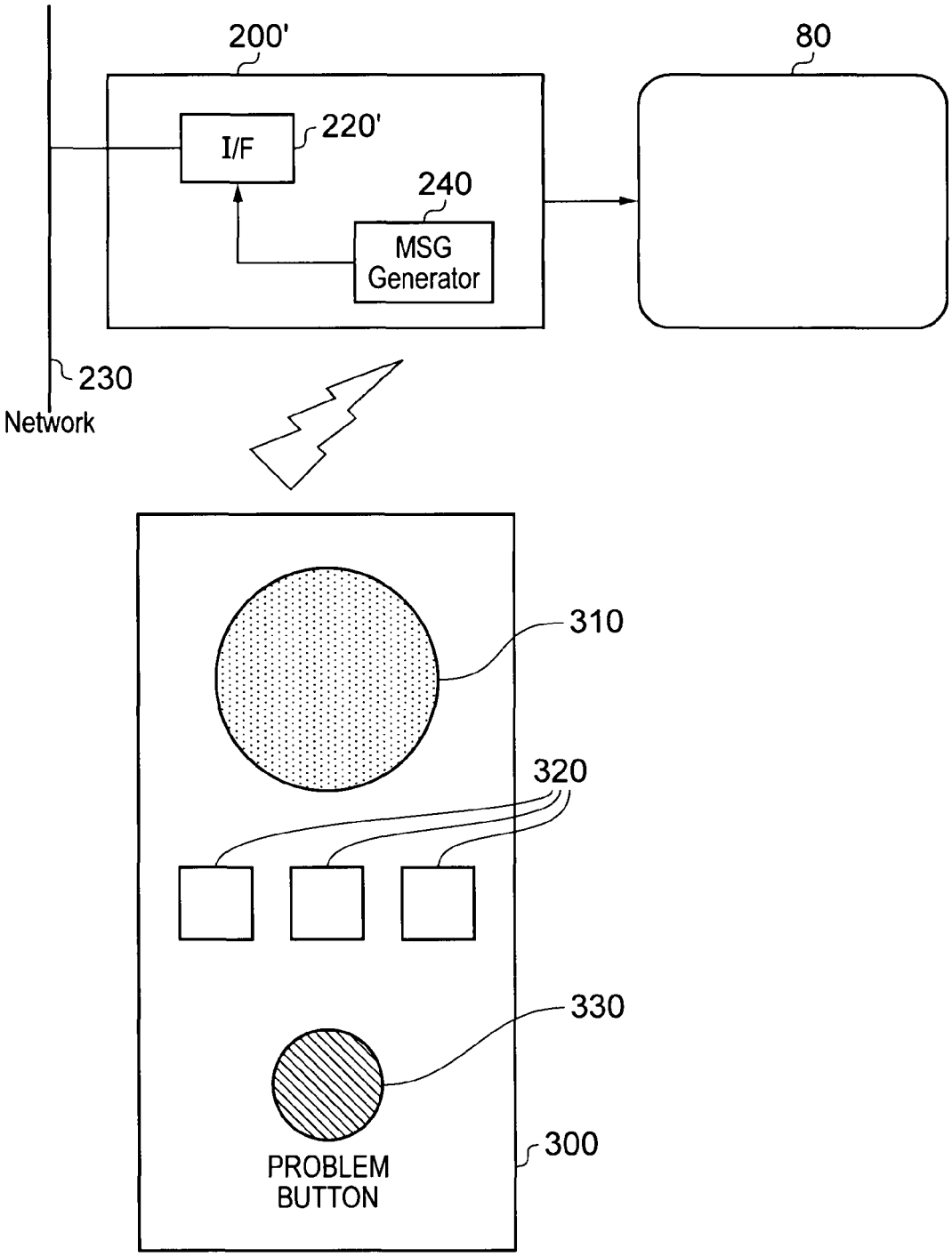
FIG. 6 schematically illustrates a receiver with a remote commander.

FIG. 6 schematically illustrates another embodiment, in which a remote commander 300 interacts wirelessly with a television receiver 200'. In FIG. 6 the remote commander is drawn larger than the television receiver 200', but it will be appreciated that this is just a schematic view and that in reality the remote commander would probably be a hand-held device. The wireless interaction can be via an interface 220' (having the functions of the interface 220 of FIG. 5, plus a wireless interface to interact with the remote commander 300) and a corresponding interface device (not shown) in the remote commander. The wireless interaction could be by known infra-red, wireless Ethernet, Bluetooth® or ZigBee® protocols.

The remote commander comprises an audio output device, such as a loudspeaker 310 (with a corresponding amplifier, not shown), one or more user operable controls (user control buttons 320) for operating conventional user remote control functions such as channel changes or other operations of the receiver, and a problem button 330.

The loudspeaker 310 is arranged to receive, via the wireless connection between the remote commander 300 and the television receiver 200', the speech output of the TTS system 50. That is to say, the generated speech is reproduced by the loudspeaker 310 rather than by the amplifier and loudspeaker 90. This has the advantage that in a mixed viewing environment, in which one user needs to use the TTS system 50 but other users can manage without, the speech output of the TTS system 50 is not imposed on all users but is directed only at the user that requires it.

The user presses the problem button 330 when the user hears a word which has not been successfully or correctly converted to speech by the TTS system 50. This could be a word which the user can recognise but which is pronounced incorrectly. Or it could be a word which the user simply cannot recognise because it has been given a nonsensical pronunciation. Pressing the problem button causes the remote commander to instruct a message generator 240 in the television receiver to send a message (for example to the broadcaster) to request update data. The message generator 240 composes the message, which may indicate a conversion problem and may indicate text converted at the time that the problem button was operated, and sends it to the broadcaster via the interface 220' and the network connection 230.

Figure 7:
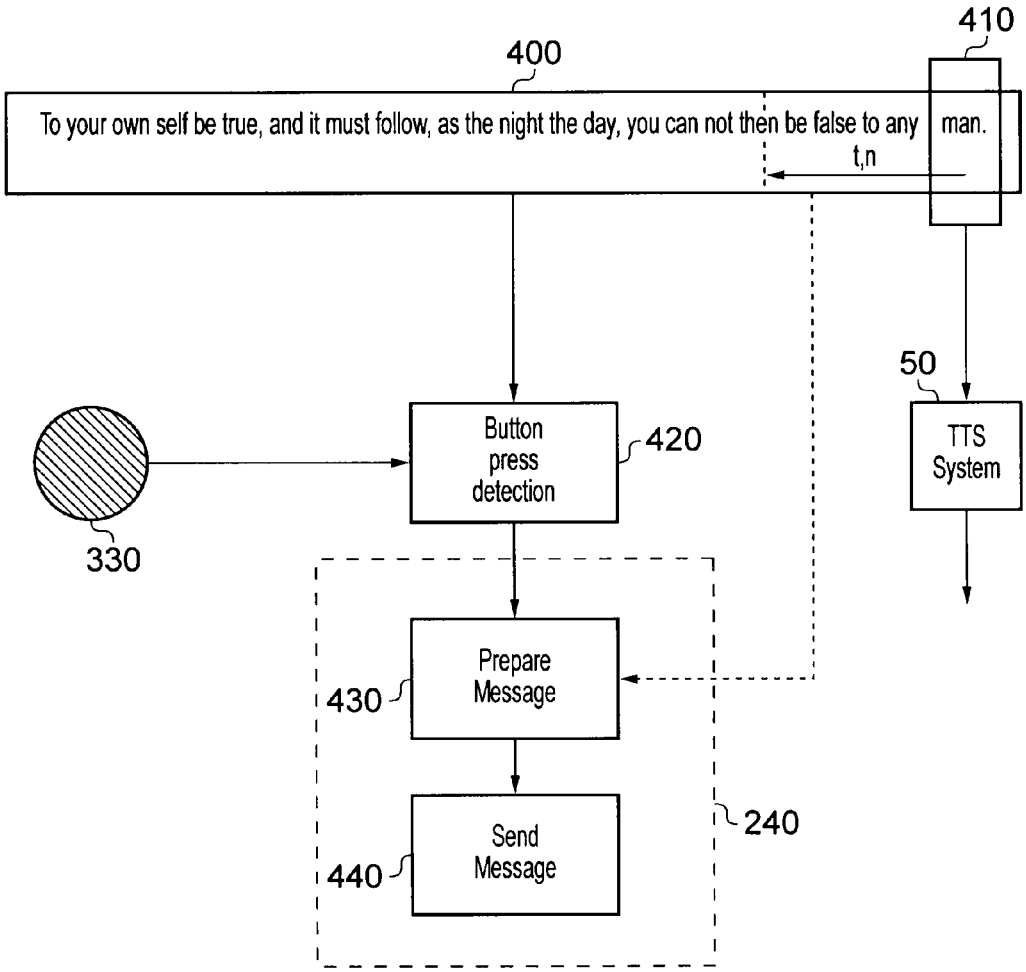
FIG. 7 schematically illustrates the generation of a problem message.

But there is a difficulty here, the solution to which is illustrated by FIG. 7, a schematic representation of the operations relating to the problem button 330.

The difficulty is that different users have different reaction times, and all users have a non-zero reaction time. This means that the word which is currently being converted and voiced, that is to say, at the time that the problem button 330 is pressed, is almost certainly not the word which triggered the pressing of the problem button.

Referring to FIG. 7, in this embodiment the TTS system 50 maintains a rolling buffer 400 of most-recently-converted words. This could be a buffer covering a certain predetermined time period, for example all words converted in the last ten seconds, or it could be based on a predetermined number of words, for example the thirty most-recently converted words, or even on the number of characters or letters relating to recently converted words, for example the most recently converted 200 characters. The word which is currently being converted is shown by a box 410.

When the problem button 330 is pressed by the user, the remote commander provides a function 420 of detecting that button operation and issuing an instruction to the message generator 240. The message generator then prepares a message (430) with reference to the buffer 400, and then sends the message (440) via the interface 220' (FIG. 6).

The message generator refers to the buffer 400 at the instant that the problem button is pressed. It selects text from the buffer 400 for inclusion in the message. The text can be selected in various ways:

(a) The message generator could select the whole of the text in the buffer 400; or (b) The message generator could select any words in the buffer 400 other than the most recently converted n words, on the basis that the user's reactions would not be quick enough to have indicated a problem in the most recently converted n words. The value n could be, for example, five. A schematic representation of the value n is shown in FIG. 7; or (c) In a similar way to (b), the message generator could use all words in the buffer except those corresponding to the most recent time period t of conversion. The value of t could be, for example, 0.1 seconds, and t is shown schematically in FIG. 7; or (d) The message generator could select the most recently converted word (amongst those in the buffer 400) which made use of a rules-based conversion based on the rules database rather than a dictionary-based conversion using the conversion dictionary. In order to achieve this, the buffer 400 may store metadata associated with each word, for example in the form of a single flag bit for each word, indicating whether that word was converted using the conversion dictionary. Alternatively, the receiver may derive such information only as it is required (that is to say, in response to the pressing of the problem button) by checking whether each word stored in the buffer 400, starting with the most recently converted word and progressing back in time, is found in the conversion dictionary. In any of these situations, words which were converted within a threshold time (for example 0.1 second) leading up to the time at which the problem button was pressed may be excluded from the search for the most recently converted word which used only the rules database. As before, this is to take into account the reaction time of the user—the user would not normally be able to press the problem button sooner than the threshold time after the voicing of the problem word.

In either of cases (b) or (c), the words included in the message represent words converted during a predetermined time period, or a predetermined number of words, preceding the time at which the button was pressed. The set of words does not however immediately precede the time at which the button was pressed.

Figure 8:
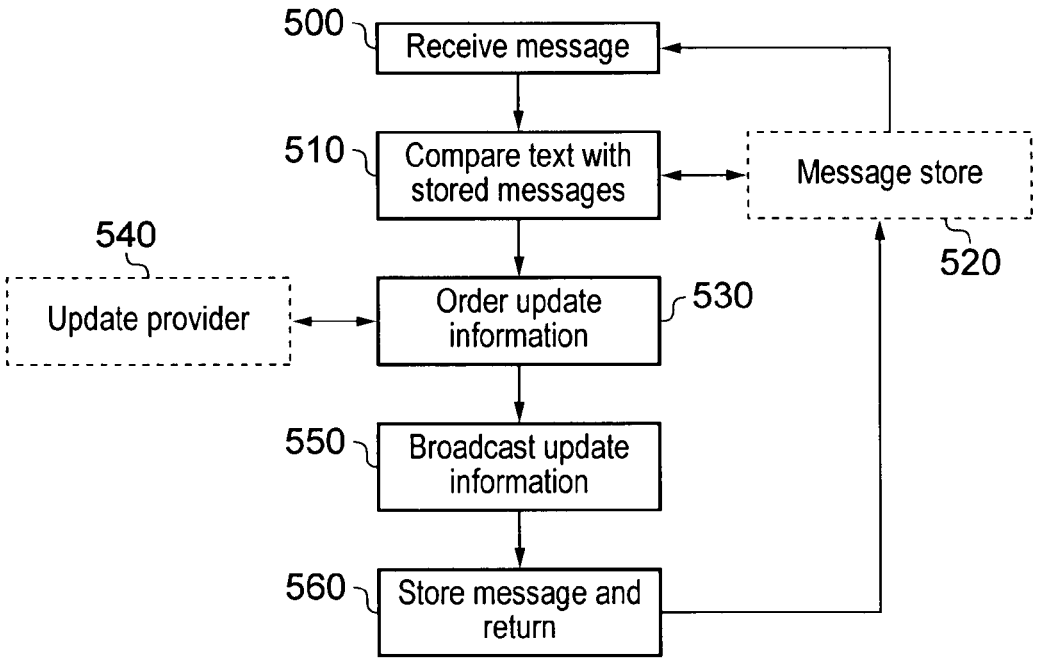
FIG. 8 schematically illustrates a broadcaster's response to a problem message.
Figure 9:
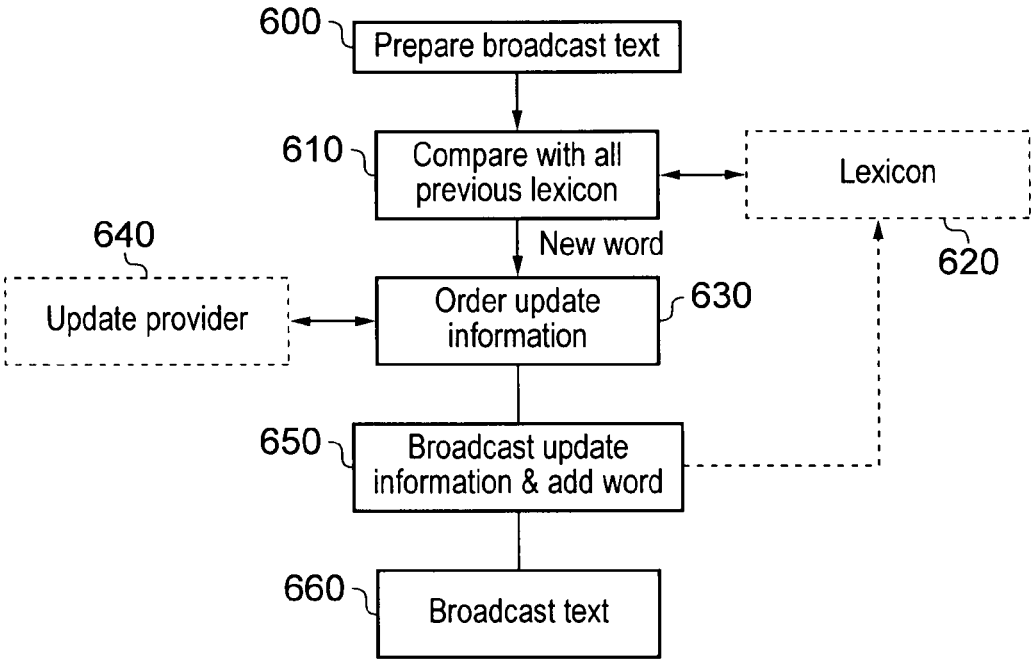
FIG. 9 schematically illustrates another technique for generating update data.

FIGS. 8 and 9 schematically illustrate operations by the broadcaster which prompt the preparation of update data in the form described above.

FIG. 8 refers to the situation described above in which the television receiver has functionality to allow an automated and/or a manually triggered message to be sent to the broadcaster indicating a conversion problem. The steps shown in FIG. 8 are carried out automatically, for example by a computer operating under program control.

At a step 500, the broadcaster receives a message (via a message receiver, not shown) indicative of a conversion problem noted by a user and requesting provision of TTS conversion information, the message indicating text which had been converted at the time that the user noted a conversion problem. As discussed above, the problem could relate to a single word (in the case of an automatically generated message) or alternatively in the case of a manually generated message there could well be some uncertainty as to which word of a group of words has a conversion problem.

In either situation, at a step 510, the broadcaster compares (using a detector, not shown) the text contained in the current message with the text contained in previously received messages, as stored in a message store 520. This step has various benefits:

(a) if the broadcaster has a policy of always providing an update after just one notification of a problem word, then the presence of the word in the message store 520 would indicate that the problem has already been dealt with. No further action is required and the process could jump to the step 560. If the word is not in the message store then control passes to a step 530.

(b) the broadcaster could defer providing an update until at least a threshold number (for example 20) of problem notifications has been exceeded. In this case, the comparison at the step 510 with the message store 520 has the function of detecting how many times the word has been flagged as a problem. If it is fewer than the threshold, then no action need be taken and the process jumps to the step 560. If the number is greater than the threshold+1 (the +1 being an optional safety margin to be sure that the threshold was exceeded), then the broadcaster can assume that the problem has already been addressed, and again no action is needed. If on the other hand the number is equal to the threshold or the threshold+1, then control can pass to the step 530.

(c) if manually generated messages are received with multiple words, one of which may represent a problem, then a correlation of messages stored in the message store 520 can indicate the problem word amongst the group, especially if the problem word occurred in various different contexts. If a word is found at the step 510 to be in common between the current message and at least (say) five previous messages, then it is assumed that a conversion problem exists in relation to the word(s) in common, and control can pass to the step 530. Otherwise, control passes to the step 560.

Control passing to the step 530 therefore assumes that a problem word (or words) has been identified and needs to be dealt with. At the step 530 the broadcaster orders an update from an update provider 540. The generation of the update is the only part of FIG. 8 which may need to be done manually, though it might be possible for the broadcaster to access a repository of digital pronunciation information to generate the update automatically. The update provider could be an employee of the broadcaster, a visual disability charity or the like.

At a step 550 the update is broadcast by an update transmitter (not shown) which, in response to a received message, transmits words and associated TTS conversions for storage at a receiver. In this way, the fact that one user (or a relatively small number of users) has indicated a problem leads to the provision of the update to all users. This is particularly advantageous in the example of EPG data, which often has a lifetime of over a week, so if a TTS pronunciation problem is resolved promptly in response to the first notification, or the first few notifications, it is possible that the majority of users will simply hear the correct pronunciation from the first time they access that EPG data.

Finally, at the step 560, the current message (or at least the problem text part of it) is stored in the message store 520, and control is passed back to the step 500 to await receipt of the next message.

FIG. 9 schematically illustrates a set of operations carried out by the broadcaster to pre-emptively detect potential problem words and issue updates to users.

At a step 600, the broadcaster prepares text (such as EPG text or teletext information) for broadcast. But before the text is actually broadcast, the steps 610 to 660 are performed.

At the step 610, the words used in the prepared text are compared with a text store providing a lexicon or list 620 of all previously used words. That is to say, the broadcaster maintains the lexicon 620 as an ordered list (for example an alphabetical list) of all words that have appeared in previously broadcast EPG and teletext information. The lexicon needs only one entry for each word—the important factor is whether a word has been used before, not how many times it has been used.

As an alternative to maintaining a list of all words that the broadcaster has ever used, the broadcaster could instead maintain a list of all words which appear in the latest updated conversion dictionary as supplied to users in that territory.

If a comparator (not shown) detects that a word in the currently prepared text is not found in the lexicon 620, then at a step 630 the broadcaster orders update information from an update provider 640 similar to the update provider 540 described above. The update includes words and associated TTS conversions for storage at a receiver.

At a step 650 the broadcaster broadcasts the update information using an update transmitter (not shown) and also adds the word to the lexicon 620.

Finally, once the update information has been first broadcast, the broadcaster broadcasts the prepared text at the step 660 using a text data transmitter (not shown). In general the text data transmitter broadcasts text data for display to the user in relation to a user interface at a receiver.

The broadcaster could apply a threshold number of occurrences before issuing an update. This would require the broadcaster to maintain a provisional list of words for updating (not shown). A word is not stored in the lexicon 620, and the update information is not broadcast at the step 550, until the word has newly occurred at least the threshold number of times in EPG text or teletext. The threshold might be three, for example. When a word in the provisional list has occurred for at least the threshold number of times, an update is broadcast 550, the word is stored in the lexicon 620 and the word is deleted (step not shown) from the provisional list.

As mentioned before, the updates comprise entries for the conversion dictionary and/or the rules database. The updates are actually broadcast (as a broadcast update signal) in private or user data fields associated with the particular broadcasting standard in use and are received by the DVB detector acting as an update receiver. The updates are broadcast multiple times, for example as part of a rotating feed of update information, so that a newly prepared update can be added to all previous updates in a carousel. The updates could be arranged so that the frequency of recurrence of an update in the carousel broadcast is related to the newness of the update, so that newer updates are rebroadcast more frequently than older updates.

The text data transmitter is a conventional part of a broadcast transmitter system. The update transmitter may be a conventional part of the broadcast transmitter system or may be implemented as an internet-based server as described above. The remaining items discussed in connection with FIGS. 8 and 9 (for example the text store, the comparator etc) may be implemented by a general purpose computer operating under software control.

Specific embodiments have been discussed in connection with DVB systems, but the techniques are also applicable to broadcast systems operating according to standards defined by (for example) the ATSC (Advanced Television Systems Committee), the ARIB (Association of Radio Industries and Businesses) which use textual service information, or to the PAL, NTSC or related standards for analogue broadcast with associated digital data (for example teletext data). Similarly, the techniques are applicable to broadcast systems other than television broadcast systems, for example radio broadcast systems such as digital radio systems according to the DAB (Digital Audio Broadcasting) standards, in which anciliary text defining current and future programmes is broadcast alongside the audio signals, and analogue radio systems such as FM broadcasts with associated text being sent via a Radio Data System (RDS) arrangement. The techniques are also applicable to text-only broadcast systems, for example radiopager, alarm or mobile telephony systems using broadcast text information to pass status or other broadcast messages to users.

The techniques are also applicable to subtitling systems. It may at first appear that TTS techniques (which are primarily intended for users with impaired sight but adequate hearing) are not directly applicable to subtitling arrangements (which are primarily intended for users with adequate sight but impaired hearing). However, there are situations in which the present techniques can in fact be very useful in a subtitling system. For example, in a dual language situation, a programme may be broadcast with audio only in a single language (for example English language), but with dual language subtitles (for example English subtitles for hearing-impaired users, and Welsh language subtitles for Welsh-speaking users irrespective of whether or not they have adequate hearing). A TTS system as described above may be used to output audio in Welsh to simulate a Welsh language audio stream.

Such a subtitling/TTS feature may therefore be useful, not only for visually impaired users, but also when a foreign language movie is broadcast. Teletext or similar subtitles (which are generally broadcast as encoded text characters) may be passed to the TTS system. DVB or similar subtitles are generally provided in a bitmap form and so would require further processing (such as known character recognition (OCR) techniques) prior to input to the TTS system.

The embodiments described above can be implemented in hardware, software, programmable hardware (such as ASICs, FPGAs etc), software-controlled computers or combinations of these.

In the case of embodiments involving software, it will be appreciated that the software itself, and a computer program product such as a storage medium carrying such software, are considered to be embodiments of the invention.

The techniques described above are applicable to broadcast systems and receivers other than television systems, for example digital radio broadcasts and receivers, where TTS techniques can be used to voice the metadata describing a programme, and mobile telephony systems, where user menus or even text messages can be handled by TTS systems in the same manner as described above.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. A broadcast signal receiver comprising:

a text data receiver configured to receive broadcast text data and to transmit the broadcast text data to a user interface, wherein the broadcast text data includes at least one word;

a text-to-speech (TTS) converter configured to convert received text data into an audio speech sound, wherein the TTS converter is configured to:

detect whether the at least one word is also included in a stored list of words, and when the at least one word is also included in the stored list of words, convert the at least one word according to a conversion defined by the stored list, and when the at least one word is not included in the stored list of words, convert the at least one word according to a set of predetermined conversion rules;

a conversion memory configured to store the list of words as initial data;

an update receiver configured to receive, from a conversion repository, and via a network connection, update data, wherein the update data includes updated words, associated conversions, and updated conversion rules, and configured to store, in the conversion memory, the update data;

and a commander circuitry configured to control an operation of the broadcast signal receiver, wherein the commander circuitry is configured to receive a user control input, wherein the user control input indicates an incorrect conversion carried out by the TTS converter; and wherein the broadcast signal receiver is configured to, in response to the user control input, send a message to a data provider, and thereby request update data, wherein the message indicates a conversion problem and indicates text which was converted, by the TTS converter, into speech.

2. The receiver according to claim 1, wherein:

the TTS converter is configured to generate the audio speech sound by assembling speech components relating to words or relating to portions of words; and the conversion memory defines, for each word stored in the conversion memory, a respective sequence of speech components which is to be used in a conversion.

3. The receiver according to claim 1, wherein the update receiver is configured to receive the update data as a broadcast update signal.

4. The receiver according to claim 1, wherein the broadcast signal receiver is a television signal receiver configured to receive a television signal, wherein the television signal has a video signal component and an audio signal component.

5. The receiver according to claim 4, wherein the broadcast text data includes electronic programme guide data and/or teletext data.

6. The receiver according to claim 5, further configured to receive the electronic programme guide data as digital service broadcast service information data.

7. The receiver according to claim 1, wherein the conversion problem corresponds to converted text that includes a predetermined number of words that were converted, before the user control input is received by the commander circuitry, into speech, or that includes words that were converted, during a predetermined period, into speech, wherein the predetermined period precedes a time when the commander circuitry receives the user control input.

8. The receiver according to claim 1, wherein a conversion made using the update data overrides a conversion made using initial data.

9. The receiver according to claim 1, wherein the update data includes update acronyms and update abbreviations.

10. The receiver according to claim 1, wherein the update data is issued in response to any one of: a scheduled data provider update, an automated request from the broadcast signal receiver, a manual request from the broadcast signal receiver, an automated request from a user of the broadcast signal receiver, or a manual request from a user of the broadcast signal receiver.

11. The receiver according to claim 1, further comprising:

a message generator configured to track whether the at least one word is converted according to a conversion defined by the stored list or is converted according to the set of predetermined conversion rules.

12. The receiver according to claim 11, wherein the broadcast signal receiver is further configured to request, when performing a conversion defined by the stored list, update words and associated conversion rules, and to request, when performing a conversion according to the set of predetermined conversion rules, updated conversion rules.

13. The receiver according to claim 11, further comprising:

a buffer configured to capture a predetermined allocation of recently converted words, wherein the message generator is further configured to generate a capture message that includes the captured predetermined allocation.

14. The receiver according to claim 13, wherein the message generator is further configured to transmit, to a data provider and via a network connection, the capture message.

15. The receiver according to claim 1, wherein the commander circuitry is remote from the broadcast signal receiver.

16. A method of broadcast signal reception, the method comprising the steps of:

receiving broadcast text data, and transmitting the broadcast text data to a user interface, wherein the broadcast text data includes at least one word;

converting received text data into an audio speech sound, wherein the converting step includes:

detecting whether the at least one word is also included in a stored list of words, and when the at least one word is also included in the stored list of words, converting the at least one word according to a conversion defined by the stored list, and, when the at least one word is not included in the stored list of words, converting the at least one word according to a set of predetermined conversion rules;

storing, in a conversion memory, the list of words as initial data;

receiving, from a conversion repository, and via a network connection, update data, wherein the update data includes updated words, associated conversions, and updated conversion rules, and storing, in the conversion memory, the update data;

receiving a user control input, wherein the user control input indicates an incorrect conversion carried out by a text-to-speech (TTS) converter; and, in response to the user control input, sending a message to a data provider, and thereby requesting update data, wherein the message indicates a conversion problem and indicates text which was converted, by the TTS converter, into speech.

17. A non-transitory computer-readable medium storing computer readable instructions thereon which, when executed by a computer, cause the computer to perform he method according to claim 16.

18. A broadcast signal receiver comprising:

a text data receiver configured to receive broadcast text data and to transmit the broadcast text data to a user interface, wherein the broadcast text data includes at least one word;

a text-to-speech (TTS) converter configured to convert received text data into an audio speech sound, wherein the TTS converter is configured to:

detect whether the at least one word is also included in a stored list of words, and when the at least one word is also included in the stored list of words, convert the at least one word according to a conversion defined by the stored list, and when the at least one word is not included in the stored list of words, convert the at least one word according to a set of predetermined conversion rules;

a conversion memory configured to store the list of words as initial data;

an update receiver configured to receive, from a conversion repository, and via a network connection, update data, wherein the update data includes updated words, associated conversions, and updated conversion rules, wherein the receiving of the update data is triggered by:

receiving a signal, from a remote device, at the broadcast signal receiver, and in response to receiving the signal, sending, via the broadcast signal receiver, a message to a data provider, and thereby requesting update data, wherein the message indicates a conversion problem and indicates text which was converted, by the TTS converter, into speech.

* * * * *